US005115519A

United States Patent [19]

Dalrymple

[11] Patent Number: 5,115,519

[45] Date of Patent: May 26, 1992

[54] GARTER WITH CONCEALED COMPARTMENT

[76] Inventor: MaryBeth H. Dalrymple, 7081 Dearwester Dr., Cincinnati, Ohio 45236

[21] Appl. No.: 736,798

[22] Filed: Jul. 29, 1991

[51] Int. Cl.[5] ..... A41B 9/00

[52] U.S. Cl. ..... 2/311; 2/247; 2/338

[58] Field of Search ..... 2/170, 162, 240, 303, 2/306, 309, 311, 312, 335, 338, 247, 59

[56] References Cited

U.S. PATENT DOCUMENTS

| | | | |
|---|---|---|---|
| 226,658 | 4/1880 | Graydon | 2/338 X |
| 367,996 | 8/1887 | Nathan | 2/247 X |
| 837,824 | 12/1906 | Gibson | 2/247 |
| 900,094 | 10/1908 | Fisher | 2/247 X |
| 918,837 | 4/1909 | Fisher | 2/247 X |
| 926,402 | 6/1909 | Geissler | 2/247 |
| 1,025,643 | 5/1912 | Presmont | 2/239 |
| 1,112,805 | 10/1914 | Kaufman | 2/247 |
| 1,382,446 | 6/1921 | Warren | 2/311 |
| 1,418,371 | 6/1922 | Foster . | |
| 1,567,460 | 12/1925 | Parsons | 2/312 |
| 1,608,096 | 11/1926 | Friedman | 2/338 |
| 1,636,107 | 7/1927 | Namiot | 2/335 X |
| 2,087,620 | 7/1937 | Lipton | 2/311 |
| 2,339,239 | 1/1944 | Carmichael | 2/311 X |
| 2,592,087 | 4/1952 | Wallace | 2/247 |
| 4,079,871 | 3/1978 | Siza | 2/247 X |
| 4,341,331 | 7/1982 | McDougall | 224/219 |
| 4,446,574 | 5/1984 | Kalomeris | 224/219 |
| 4,462,116 | 7/1984 | Sanzone et al. | 2/170 |
| 4,525,879 | 7/1985 | Kalomens | 2/338 |
| 4,532,656 | 8/1985 | Suzuki | 2/247 |
| 4,698,854 | 10/1987 | Slummon | 2/247 |

OTHER PUBLICATIONS

Gershman, Maurice, "Self Adhering Nylon Tapes", The J.A.M.A., vol. 168, No. 7, Oct. 1958.

*Primary Examiner*—Werner H. Schroeder
*Assistant Examiner*—Jeanette E. Chapman
*Attorney, Agent, or Firm*—Wood, Herron & Evans

[57] ABSTRACT

A garter with a concealed compartment is disclosed comprising a band with an outer covering providing the appearance of clothing. The garter's appearance allows a user to safely carry and conceal money and other valuables in the concealed compartment eliminating vulnerability to loss and theft. The garter is especially adapted for use by a woman as an undergarment.

1 Claim, 1 Drawing Sheet

GARTER WITH CONCEALED COMPARTMENT

BACKGROUND OF THE INVENTION

Problems arising from carrying money, keys and other valuables are especially acute in the case of women whose garments are often devoid of pockets. Purses can be lost and are vulnerable to theft. Money belts tend to be restrictive and awkward, and do not appear as normal articles of clothing.

Various carrying devices for wearing on the exterior clothing are known. U.S. Pat. No. 4,446,574 discloses a ladies belt intended for wearing on the outside of the clothing which may be tied, buckled or otherwise fastened. The belt contains pockets constructed on the inside of the belt.

Additionally, carrying devices for securing beneath the outer clothing are known. The belt shown in U.S. Pat. No. 1,418,371 is intended to be worn under clothing. Further, U.S. Pat. No. 1,382,446 discloses a garter having a purse located on the outside of the leg band for storing and carrying articles.

Other carrying devices are specifically tailored for certain uses. For example, U.S. Pat. No. 4,341,331 discloses an article holder specifically tailored for surfers or swimmers for containing a key and strapping the key to the wrist or ankle.

There is a need, therefore, for an article that can conceal money, keys and other valuables while appearing as a normal article of clothing.

SUMMARY OF THE INVENTION

In a broad aspect of the present invention, a garter is provided having a concealed compartment for carrying money and other valuables.

In a more specific aspect of the present invention, a garter is provided having a band for encircling and securement to a wearer's limb, especially the leg. The band has an outer covering made from fabrics selected from the group of cotton, polyesters, silk and lace providing the appearance of an article of clothing.

In a preferred embodiment of the present invention, an inner panel separated from the outer covering forms a concealed compartment between the inner panel and outer covering. The inner panel is made from fabric providing comfort to the wearer. The concealed compartment has means for closure selected from the group of snaps and Velcro. The means for closure are mounted on the inside of the band hidden from view.

In another embodiment, the concealed compartment is formed by the outer covering and inner panel in juxtaposed position with their marginal edges forming an opening having hidden means for closure.

In a further embodiment of the present invention, an elastic band for encircling and securement to a wearer's leg is provided. The band has an outer covering made from a fabric providing the appearance of an undergarment. An inner panel made from fabric is also provided. The inner panel is separated from the outer covering forming a concealed compartment between the inner panel and outer covering whose juxtaposed marginal edges form an opening having hidden snap or Velcro means for closure. The concealed compartment is additionally provided with a lining between the inner panel and outer covering. Furthermore, the elastic band is provided by the placement of an elastic webbing between the outer covering and inner panel.

BRIEF DESCRIPTION OF THE DRAWINGS

The structure and advantages of a specific embodiment of this invention will become further apparent upon consideration of the following detailed description taken in conjunction with the accompanying drawings, wherein.

DETAILED DESCRIPTION OF THE INVENTION

To illustrate and provide a more complete and thorough understanding of the present invention, the following detailed description is given concerning the garter and its novel features.

Figure 1:
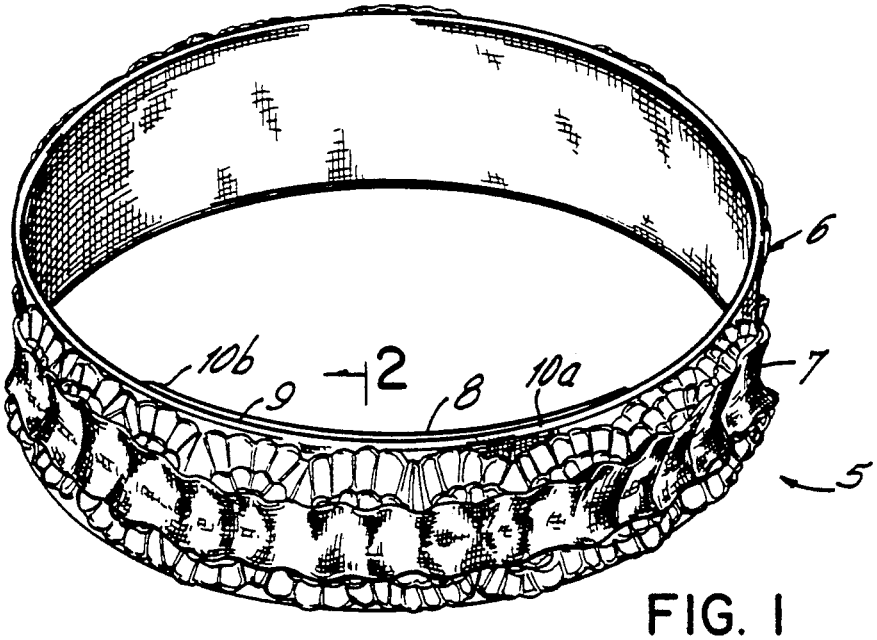
FIG. 1 is a perspective view of a specific embodiment of the present invention illustrating a completely expanded garter having a closed concealed compartment.

Referring now more particularly to the figures in which like reference characters indicate like elements throughout, the completely expanded garter in FIG. 1 shown generally at 5 has a band 6 for encircling and securement to a wearer's leg. Band 6 has an outer covering 7 made from fabrics selected from the group of cotton, polyesters, silk and lace. The outer covering 7 made from fabrics provides the appearance of an article of clothing.

Figure 2:
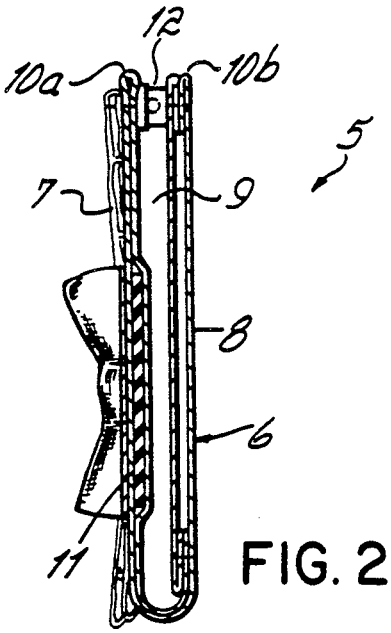
FIG. 2 is a cross-sectional view taken along line 2—2 of FIG. 1 illustrating an inner panel secured to an outer covering forming a compartment.

Illustrated in FIG. 2, a cross-sectional view taken along line 2—2 of FIG. 1, outer covering 7 is separated from an inner panel 8 forming a compartment 9 between outer covering 7 and inner panel 8. Inner panel 8 is made from fabric providing comfort to the wearer.

Referring now more specifically to FIG. 2 of the drawings to illustrate further the features of the present invention, compartment 9 is formed by outer covering 7 having a marginal edge 10*a* and inner panel 8 having a marginal edge 10*b* in juxtaposed position. Marginal edge 10*a* and marginal edge 10*b* are flush thereby providing concealment of inner panel 8 and compartment 9. Compartment 9 has a fastened snap means 12 for closure of the opening formed by marginal edge 10*a* and marginal edge 10*b*. Other means for closure suitable for use with this invention include Velcro.

Further illustrated in FIG. 2, an elastic webbing 11 is placed between outer covering 7 and inner panel 8. This feature enables the present invention to be elastic for a more secure and universal fit.

Figure 3:
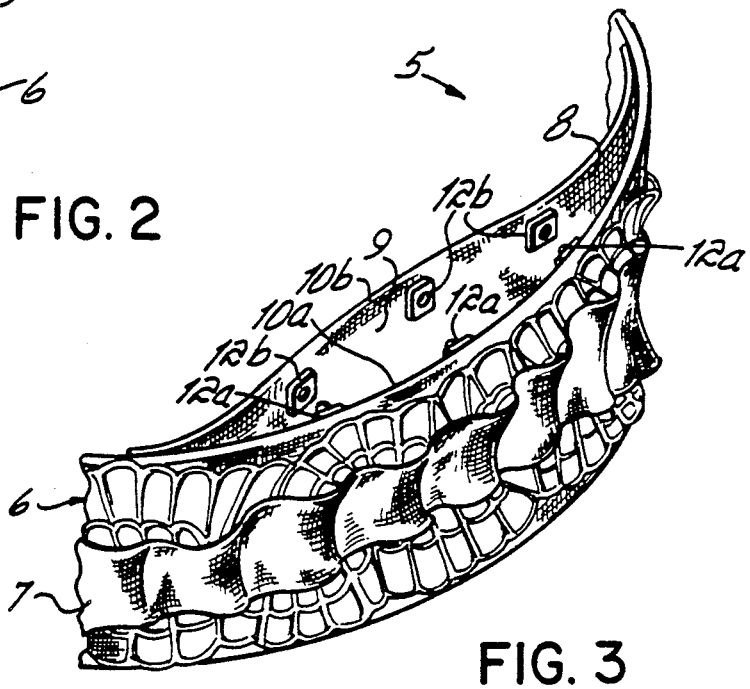
FIG. 3 is a fragmented perspective view of a specific embodiment of the present invention illustrating an opening having unsecured snap means for closure.

Illustrated in FIG. 3, a fragment of garter 5 has outer covering 7 and inner panel 8 whose marginal edges 10*a* and 10*b* form an opening. Located on outer covering 7 and inner panel 8 are male snaps 12*a* and female snaps 12*b*. Insertion of snaps 12*a* into 12*b* provides means for closure of the opening formed by marginal edges 10*a* and 10*b*. Further, snaps 12*a* and 12*b* are mounted on the inside of outer covering 7 and inner panel 8 hidden from view.

In all the embodiments, a simple and effective article of clothing is provided which will be of great benefit to the wearer for concealing valuables, especially when the wearer is devoid of pockets. This invention is especially suitable for women and can be worn as an undergarment to safely hide their hidden treasure or other valuables.

While the invention has been described with reference to a specific embodiment, one skilled in the clothing apparel art will appreciate that modifications and variations of the invention may be constructed without departing from the scope of the invention which is defined in the following claims.

What is claimed is:

1. An undergarment for women for having a concealed compartment comprising an elastic band for encircling and securement to a wearer's leg, said band has an outer covering made from a fabric providing the appearance of an undergarment; and an inner panel made from fabric separated from the outer covering to form a concealed compartment between said inner panel and outer covering whose juxtaposed marginal edges form an opening having hidden means for closure to form said concealed compartment, said concealed compartment having a lining between said inner panel and outer covering;

an elastic webbing is placed between said outer covering and inner panel to provide said elastic band.

* * * * *